United States Patent [19]

Opsahl

[11] Patent Number: 4,564,397

[45] Date of Patent: Jan. 14, 1986

[54] COMPOSITION AND PROCESS FOR INHIBITING CORROSION OF FERROUS OR NON-FERROUS METAL SURFACED ARTICLES AND PROVIDING RECEPTIVE SURFACE FOR SYNTHETIC RESIN COATING COMPOSITIONS

[75] Inventor: Ross C. Opsahl, Roselle, Ill.

[73] Assignee: J. N. Eltzroth & Associates Inc., Palatine, Ill.

[21] Appl. No.: 622,993

[22] Filed: Jun. 21, 1984

[51] Int. Cl.[4] ..... C23F 7/10

[52] U.S. Cl. ..... 148/6.15 R; 148/6.15 Z; 148/31.5

[58] Field of Search ..... 148/6.14 R, 6.15 Z, 148/6.15 R; 204/181 T, 181 R, 181 C

[56] References Cited

U.S. PATENT DOCUMENTS

| | | | |
|---|---|---|---|
| 2,817,610 | 12/1957 | Newell | 148/6.14 R |
| 3,493,440 | 2/1970 | Ashdown | 148/6.15 R |
| 3,776,782 | 12/1973 | Kiefer | 148/6.15 R |
| 3,816,185 | 6/1974 | Toledo | 148/6.14 R |
| 4,381,249 | 4/1983 | Bouffard | 148/6.17 |

*Primary Examiner*—Sam Silverberg

*Attorney, Agent, or Firm*—Michael G. Berkman

[57] ABSTRACT

Phosphate coated ferrous and non-ferrous metal surfaced articles are passivated without treatment by a chromium compound by rinsing with an aqueous solution of urea or a urea derivative, or an acidulated urea or urea derivative in an amount sufficient to form a corrosion resistant barrier on the surface which is receptive to synthetic resinous coating compositions.

13 Claims, No Drawings

COMPOSITION AND PROCESS FOR INHIBITING CORROSION OF FERROUS OR NON-FERROUS METAL SURFACED ARTICLES AND PROVIDING RECEPTIVE SURFACE FOR SYNTHETIC RESIN COATING COMPOSITIONS

BACKGROUND

Ferrous and non-ferrous surfaced articles may suffer surface deterioration by corrosion through contact with the atmosphere or moisture, or both. Chemical passivation treatments are widely used to inhibit or suppress such surface corrosion.

One of the passivating treatments employed for this purpose consists in treating the ferrous or non-ferrous surface with an aqueous solution of phosphoric acid or its salt. Various types of chromic acid compositions have also been used.

While phosphate and chromic acid based passivating solutions have been widely adopted, they have been by no means effective in preventing corrosion under all conditions, especially where the treated surface is further coated with a synthetic resin coating composition which dries to form a synthetic resinous film. Excellent results have been obtained in the use of chromic acid-containing compositions as described, for example, in U.S. Pat. No. 4,266,988. However, due to environmental considerations, there is a need to provide a passivating treatment for ferrous and non-ferrous metal surfaced articles which eliminates a requirement for chromium compounds while at the same time providing a passivating treatment wherein the ferrous or non-ferrous metal surface is receptive to a synthetic resinous coating composition. This need is particularly important in processes where a synthetic resinous coating composition such as a primer-type paint is electrodeposited from a large electrodeposition bath, which bath in due course may involve a disposal problem in which the presence of chromium compounds would complicate the solution to the problem.

An object of this invention is to provide a treatment for ferrous and non-ferrous metal coated articles so as to passivate the surfaces of said articles and make them receptive to synthetic resinous films, especially when such films are electro-deposited, without requiring the use of a chromium compound.

Another object of the invention is to provide a process in which a ferrous or non-ferrous metal such as, for example, cold rolled steel, galvanized steel and aluminum having a zinc phosphate, iron phosphate or manganese-iron phosphate surface is given a rinse with a non-chromium containing solution which acts as a chemical binding agent so as to passivate the final surface and provide better corrosion resistance.

BRIEF SUMMARY OF THE INVENTION

In accordance with the invention a ferrous or non-ferrous metal surfaced article such as, for example, cold rolled steel, zinc surfaced steel (e.g., galvanized steel), or aluminum after first being provided with a zinc phosphate, iron phosphate or manganese-iron phosphate coating according to well known processes is rinsed with an aqueous solution of urea or an acidulated urea under conditions such that a corrosion resistant barrier is formed on the surface which is receptive to synthetic resinous coating compositions, preferably being applied after rinsing the surface with deionized water. Especially good results have been obtained where the synthetic resinous coating such as a primer coating of paint is electrodeposited from an aqueous electrodeposition bath where the article to be coated is the cathode.

In its broader aspects the invention also contemplates the use of thiourea, halogenated ureas, halogenated thioureas, alkylated ureas where the alkyl groups contain 1 to 6 carbon atoms, alkoxylated ureas where the alkoxy groups contain 1 to 6 carbon atoms, and ureas in which hydrogen atoms attached to the nitrogen atoms are substituted with aryl groups such as phenyl or aralkyl groups such as benzyl.

DETAILED DESCRIPTION OF THE INVENTION

In the practice of the invention ferrous or non-ferrous metals such as cold rolled steel, galvanized steel and aluminum which contain surface coatings of zinc phosphate, iron phosphate, or manganese-iron phosphate are rinsed with an aqueous solution of urea or a urea derivative containing a sufficient amount of the urea or urea derivative, usually about 0.1%–0.2% by weight of the solution, to provide a corrosion resistant barrier on the resultant surface which enhances the corrosion resistance and at the same time provides a surface which is receptive to synthetic resinous coatings applied in any number of ways but especially synthetic resinous coatings applied by electrodeposition where the metal article is the cathode in an electrodeposition bath.

While the invention is not limited to any theory, it is thought that the urea (or its derivatives) complexes with the metal and its phosphate coating and polymerizes providing a corrosion resistant barrier on the surface. The residual active sites of zinc and iron are chemically bound to the urea. Any unreacted phosphates can react directly with the urea. Thus, the urea acts as a chemical bonding and polymerizing agent to passivate the final surface and provide better corrosion resistance.

The temperature of the treatment can vary from room temperature to the boiling point of the solution being applied.

The pH of the coating solution can vary depending on the concentration and in the case of the urea solution alone, is slightly alkaline, However, it is preferable to use a solution in which the pH range is from about 0.8 to 6.5.

The treating solution can also contain one or more oxidizing agents to wash and/or purify the surface and for this purpose nitric acid and alkali metal and alkaline earth metal salts thereof are effective.

Any number of acids may be used to control the pH including, for example, sulfuric acid, boric acid, and fluosilicic acid (50% by weight $H_2SiF_6$).

While the invention is preferably practiced by the use of the simple compound urea, either alone or in combination with acidulating ingredients, compounds represented by the general formula

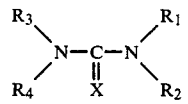

wherein X represents 0 or S, $R_1$, $R_2$, $R_3$ and $R_4$ represent hydrogen, halogen (i.e., chlorine, bromine, fluorine, or iodine), alkyl (e.g., methyl, ethyl, propyl, isopropyl, butyl, isobutyl, amyl, isoamyl or hexyl), aryl (e.g., phenyl), or alkoxy (e.g., methoxy, ethoxy, propoxy), or aralkyl (e.g. benzyl), may be employed.

The invention will be further illustrated by the following examples in which quantities are given by weight unless otherwise indicated.

EXAMPLE I

A composition was prepared by adding 20 grams of urea to a liter of tap water to produce a solution containing 2% by weight urea.

This composition was then diluted to a 0.2% concentration by adding more tap water and the composition was used as a final rinse on phosphated galvinized steel, phosphated aluminum, and phosphated cold rolled steel. The time of treatment was 1–2 minutes.

The resultant treated product was then given a primer coat of a synthetic resinous coating using an epoxy-type primer. A polyester top coat was applied over the primer coat to give the finished product.

EXAMPLE II

A composition in the form of a concentrate was prepared by mixing 200 grams urea, 40 grams calcium nitrate and 100 ml of a 50% by weight fluosilicic acid solution at room temperature. This composition was diluted by adding water to a total volume of 500 ml. During the addition, an endothermic reaction occurred.

The composition was then diluted with tap water to a concentration of 0.1% and applied as a final rinse over zinc phosphated treated cold rolled steel, aluminum and galvanized steel.

The metals to be treated were immersed in the aqueous solution of the foregoing concentrate for 2 seconds to 2 minutes at temperatures from room temperature to 140° F.

After immersion the treated articles were rinsed with deionized water. This treatment was found to be very effective in inhibiting corrosion.

Articles treated in the manner described in this example were cathodic electrocoated with a primer paint and subsequently given a top coating with excellent results.

The amount of urea deposited on the metal will depend to some extent upon the concentration of urea in the composition applied to the phosphate coated metal and the time of treatment. Usually a concentration of 0.1% to 0.2% by weight of urea in the treating composition is sufficient. Acidulation of the urea also affects the time of treatment and tends to reduce the time of treatment.

The time of treatment is usually anywhere from two seconds to two minutes or, in the case of a continuous strip, at a rate up to about 750 feet per minute. A water rinse with deionized water is desirable where the article is to be cathodically electrocoated with a primer synthetic resinous coating.

The synthetic resinous coating or paint may be, for example, an epoxy primer with a polyester top coat. A more specific example is a Plastisol (Sherwin-Williams) primer which is an epoxy urethane and a Plastisol top coat which is a polyvinyl chloride consisting essentially of 85% solids dispersed in plasticizers. Any of the well known primers used in the electrodeposition processes can be employed.

The invention is especially useful in treating automotive car bodies and frames prior to cathodic electrodeposition of synthetic resinous primers.

The invention is hereby claimed as follows:

1. A process of passivating the surfaces of ferrous and non-ferrous metals which have a coating of zinc phosphate, iron phosphate or manganese-iron phosphate which comprises rinsing said coated surfaces with an aqueous solution of urea, an acidulated urea, or a compound containing a urea moiety in sufficient amount and under conditions so as to form a resistant barrier on said surfaces and coating said corrosion resistant barrier with a synthetic resinous coating composition.

2. A process as claimed in claim 1 in which the aqueous solution applied to the phosphate coated surface of the metal consists essentially of a solution of urea.

3. A process as claimed in claim 1 in which the aqueous solution applied to the phosphate coated surface of the metal consists essentially of an acidulated urea having a pH within the range of 0.8 to 6.5.

4. A process as claimed in claim 1 in which the aqueous solution applied to the phosphate coated surface of the metal consists essentially of a solution of urea, calcium nitrate and fluosilicic acid.

5. A process as claimed in claim 1 in which the coated metal surface is given a final rinse with deionized water and cathodically electrocoated with a primer paint.

6. A process as claimed in claim 2 in which the coated metal surface is given a final rinse with deionized water and cathodically electrocoated with a primer paint.

7. A process as claimed in claim 3 in which the coated metal surface is given a final rinse with deionized water and cathodically electrocoated with a primer paint.

8. A process as claimed in claim 4 in which the coated metal surface is given a final rinse with deionized water and cathodically electrocoated with a primer paint.

9. A composition in the form of a concentrate prepared by mixing urea, calcium nitrate and a fluosilicic acid solution in proportions corresponding to 200 grams urea, 40 grams calcium nitrate and 100 ml of a 50% by weight fluosilicic acid solution at room temperature followed by diluting with water to a total volume of 500 ml, which composition when further diluted with water to a concentration of 0.1% by weight solids is adapted to be applied as a final rinse over phosphated cold rolled steel, aluminum and galvanized steel so as to form a corrosion resistant barrier coating which is receptive to synthetic resinous coating compositions.

10. A coated meal produced in accordance with the process of claim 1.

11. A coated metal produced in accordance with the process of claim 3.

12. A coated metal produced in accordance with the process of claim 4.

13. A coated metal produced in accordance with the process of claim 5.

* * * * *

UNITED STATES PATENT AND TRADEMARK OFFICE

CERTIFICATE OF CORRECTION

PATENT NO. : 4,564,397

DATED : January 14, 1986

INVENTOR(S) : Ross C. Opsahl

It is certified that error appears in the above-identified patent and that said Letters Patent is hereby corrected as shown below:

Please change assignee designation from "J. N. Eltzroth & Associates Inc." to --J. M. Eltzroth & Associates Inc.--.

Signed and Sealed this

*Twenty-seventh* Day of *May 1986*

[SEAL]

*Attest:*

DONALD J. QUIGG

*Attesting Officer*

*Commissioner of Patents and Trademarks*